United States Patent [19]

Profera et al.

[11] 4,246,583

[45] Jan. 20, 1981

[54] MULTIMODE FEED FOR A MONOPULSE RADAR

[75] Inventors: Charles E. Profera, Cherry Hill; James J. Campbell, Medford, both of N.J.

[73] Assignee: RCA Corporation, New York, N.Y.

[21] Appl. No.: 21,195

[22] Filed: Mar. 16, 1979

Related U.S. Application Data

[63] Continuation-in-part of Ser. No. 864,610, Dec. 27, 1977, abandoned.

[51] Int. Cl.[3] ..... H01Q 19/13; H01P 1/16

[52] U.S. Cl. ..... 343/781 CA; 333/21 R

[58] Field of Search ..... 333/21 R, 21 A; 343/779, 786, 781 CA, 16 M

[56] References Cited

U.S. PATENT DOCUMENTS

| | | | |
|---|---|---|---|
| 3,373,431 | 3/1968 | Webb | 333/21 R |
| 3,701,163 | 10/1972 | Grabowski | 343/786 |
| 3,714,652 | 1/1973 | Grabowski et al. | 343/786 X |

OTHER PUBLICATIONS

Profera et al., *An Improved Cassegrain Monopulse Feed System*, RCA Review, vol. XXVIII, No. 4, Dec. 1967.

*Primary Examiner*—Paul L. Gensler

*Attorney, Agent, or Firm*—Samuel Cohen; Joseph D. Lazar; Robert L. Troike

[57] ABSTRACT

A rectangular waveguide housing and a waveguide radiator have coaxial cavities that are contiguous. A pair of perpendicular walls intersect substantially on the axis of the housing to form therein four similar rectangular subwaveguides that may be excited to propagate electromagnetic waves in a $TE_{10}$ mode. The walls have edges that are in the boundary between the contiguous cavities. A pair of intersecting tabs extend from the edges into the radiator. Additionally, a protrusion extends within the radiator from the intersection of the tabs. The polarities of the waves in the subwaveguides are selected to cause an electromagnetic wave to propagate through the radiator in either of two orthogonal difference modes or a sum mode that has desired beam shaping properties. The protrusion causes one of the difference modes to have a desired polarization.

4 Claims, 9 Drawing Figures

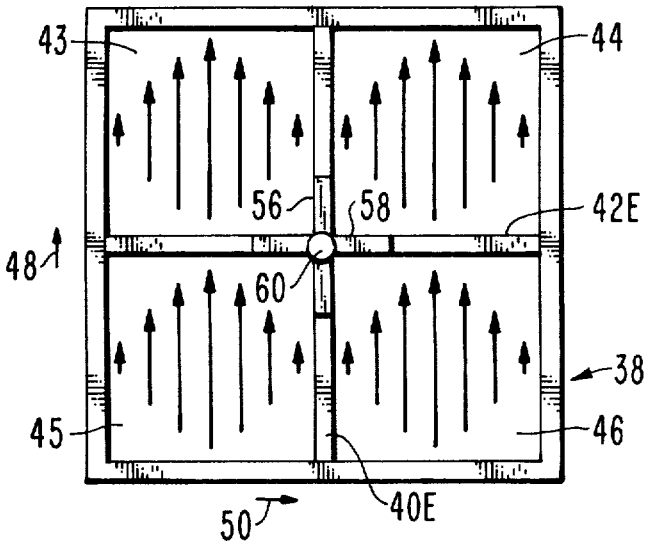
Fig. 3a.
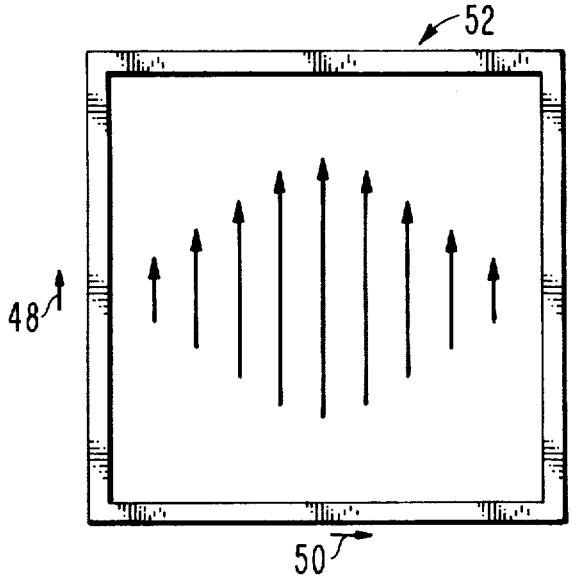
Fig. 4a.
Fig. 4b.
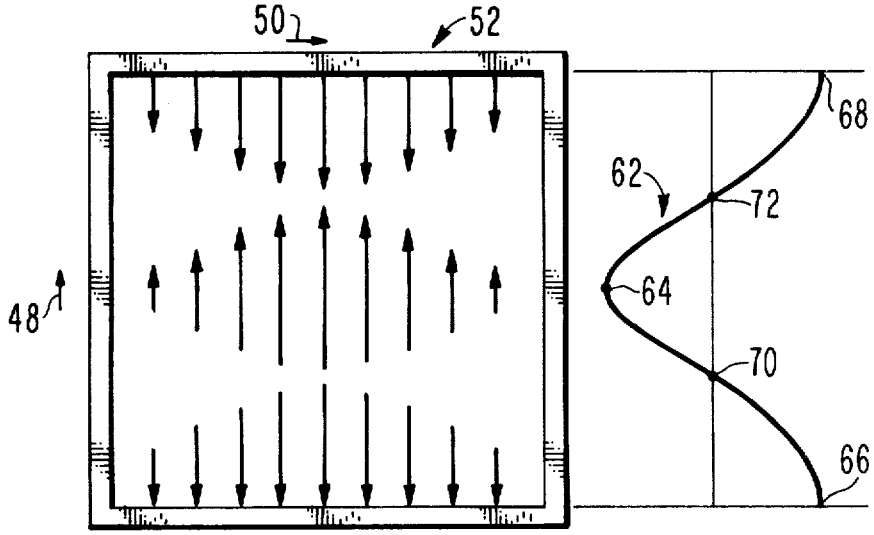

MULTIMODE FEED FOR A MONOPULSE RADAR

This patent application is a continuation-in-part of United States Patent Application Ser. No. 864,610 filed Dec. 27, 1977 and now abandoned.

BACKGROUND OF THE INVENTION

1. Field of Invention

This invention relates to the propagation of electromagnetic waves and more particularly to monopulse radar.

2. Description of the Prior Art

A multimode feed of a monopulse radar typically includes a waveguide with a cavity of a large cross-sectional size and a waveguide with a cavity of a small cross-sectional size. The ends of the larger waveguide are respectively connected to an end of the smaller waveguide and the input of a horn radiator.

The difference between the cross-sectional sizes causes the connection between the waveguides to form what is known as a discontinuity. Because of the discontinuity, when an electromagnetic wave propagates in a $TE_{10}$ mode through the smaller waveguide towards the larger waveguide, electromagnetic waves propagate through the larger waveguide in the $TE_{10}$ mode and higher order modes. The size of the large waveguide is selected to prevent a propagation of a wave in a $TE_{30}$ mode or a mode of higher order than the $TE_{30}$ mode.

One of the higher order modes of propagation within the larger waveguide is an $LSE_{12}$ mode. The waves that propagate through the larger waveguide in the $LSE_{12}$ and $TE_{10}$ modes (referred to as sum mode waves hereinafter) comprise an electromagnetic wave that propagates in the sum mode of the monopulse radar.

Usually, the larger waveguide has a length that causes the sum mode waves to have a phase change of 360 degrees relative to each other when they propagate from the discontinuity to the aperture of the horn. Because of the 360° phase change, there is a desired relative phase at the aperture between the sum mode waves.

One undesired aspect of the multimode feed is that a deviation of the frequency of excitation of the multimode feed from a center frequency causes a directly related deviation of the phase change from 360 degrees. When the deviation of the phase change is large, the radar is inoperative. Therefore, the deviation of the phase change is a limitation on the bandwidth of the multimode feed.

In addition to the sum mode waves, there are typically electromagnetic waves that propagate through the layer waveguide in an $LSE_{11}$ mode and $TE_{20}$ mode. As known to those skilled in the art, the $LSE_{11}$ and $TE_{20}$ modes are the difference modes of the radar.

Another undesired aspect of the multimode feed is that it usually causes the polarization of the waves that propagate in the $LSE_{11}$ and $TE_{20}$ modes to have a component that is orthogonal to the polarization of the sum mode waves. When the radiator causes the orthogonal polarization, the multimode feed is said to depolarize the wave that propagates in the $LSE_{11}$ and $TE_{20}$ modes. A processing of a signal derived from a depolarized electromagnetic wave may provide erroneous data relating to the azimuth and elevtion of a target.

SUMMARY OF THE INVENTION

According to a first aspect of the present invention, the cavity of a waveguide radiator has one end with a rectangular cross-section substantially the same as the cross-section of the cavity of a rectangular waveguide housing. The radiator and the housing are coaxially connected end to end with their cavities contiguous. A pair of perpendicular walls intersect substantially along the axis of the housing to divide the cavity thereof into four rectangular subwaveguides. Edges of the walls are substantially in the boundary between the contiguous cavities. A tab is connected to an edge of one of the walls to intersect the axis and extend within the radiator. The edges of the walls and the tab form a discontinuity that causes $LSE_{12}$ and $TE_{10}$ modes of propagation of electromagnetic waves through the radiator when electromagnetic waves propagate in the $TE_{10}$ mode through the subwaveguides with similar polarizations parallel to the tab.

According to a second aspect of the present invention, when the waves that propagate in the $TE_{10}$ mode in the subwaveguides have opposite polarizations on opposite sides of the wall perpendicular to the tab, an electromagnetic wave propagates through the radiator in an $LSE_{11}$ mode. A protrusion that extends from the tab into the radiator has a length selected to prevent a depolarization of the wave that propagates in the $LSE_{11}$ mode.

BRIEF DESCRIPTION OF THE DRAWING

FIGS. 3*a*–3*c* are graphic representations of fields that are established within the multimode feed of FIG. 2 in a plane that includes the lines 3—3 of FIG. 2; and FIGS. 4*a*–4*d* are graphic representations of fields that are established within a radiator of FIG. 2 in a plane that includes lines 4—4 of FIG. 2.

DESCRIPTION OF THE PREFERRED EMBODIMENT

The present invention is a multimode feed that is included in a radiation element of a monopulse radar. The multimode feed is a network of subwaveguides that are each excited in a $TE_{10}$ mode when a radiator connected thereto is excited in the sum and difference modes of the monopulse radar. The invention is predicated upon coupling the multimode feed to the radiator via a discontinuity. A first feature of the invention is that there is no depolarization of electromagnetic waves that propagate from the multimode feed through the radiator and vice versa. A second feature of the invention is that the radiation element has a wider bandwidth than radiation elements of the prior art.

Figure 1:
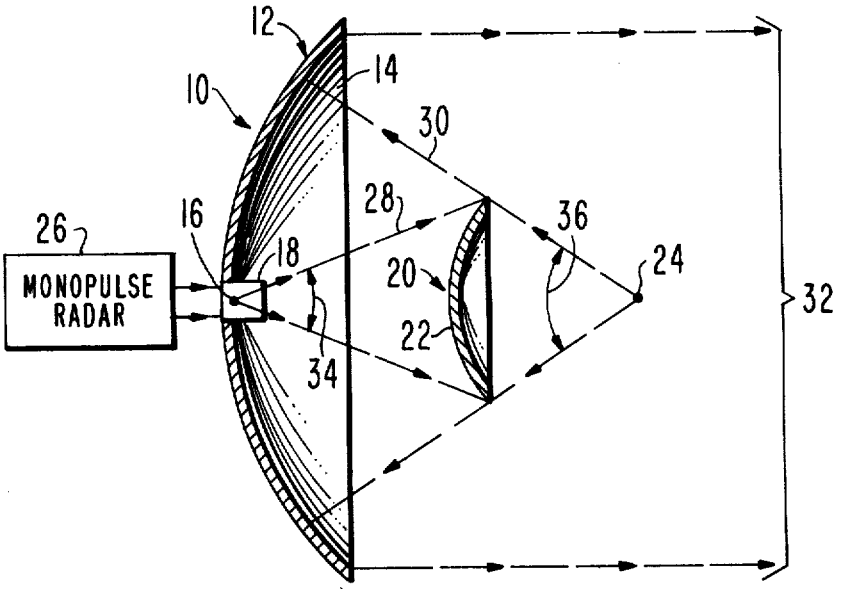
FIG. 1 is a side elevation of a Cassagrain antenna, partly in a section taken along the axis of the antenna, in accordance with the preferred embodiment of the present invention.

As shown in FIG. 1, a Cassagrain antenna 10 includes a paraboloid reflector 12 with a concave reflecting surface 14. Paraboloid 12, at a point 16 along its axis thereof, is connected to a radiation element 18, which is described hereinafter.

Antenna 10 additionally includes a hyperboloid subreflector 20 that has a convex reflecting surface 22 disposed opposite surface 14. Moreover, at a point 24, one focal point of hyperboloid 20 is coincident with the focal point of paraboloid 12. The other focal point of hyperboloid 20 is coincident with center 16.

Radiation element 18 is connected to a monopulse radar 26, whereby excitation is applied to radiation element 18. In response to the excitation, an electromagnetic wave 28 is transmitted from radiation element 18 to surface 22 and is reflected therefrom, whereby a first reflected wave 30 propagates from surface 22 to surface 14. Wave 30 is reflected from surface 14, thereby causing a second reflected wave 32 to propagate through a spatial region; wave 32 is collimated. It should be appreciated that antenna 10 is bilaterial, whereby a collimated wave from the spatial region is reflected by antenna 10 to radiation element 18 to provide excitation to radar 26.

Preferably, wave 28 has a divergence represented by an angle 34 that causes a substantial portion of wave 28 to be incident upon surface 22. Correspondingly, wave 30 has a divergence represented by an angle 36 that causes a substantial portion of wave 30 to be incident upon surface 14. As known in the prior art, angle 34 is of size that requires a radiation pattern representative of wave 28 to have reduced side lobes.

It should be understood that angle 34 is representative of a small divergence compared with the divergence represented by angle 36. It is well known that aperture size and divergence are inversely related. Accordingly, radiation element 18 has a large aperture, whereby radiation element 18 is large enough to include the subwaveguides referred to hereinbefore.

Figure 2:
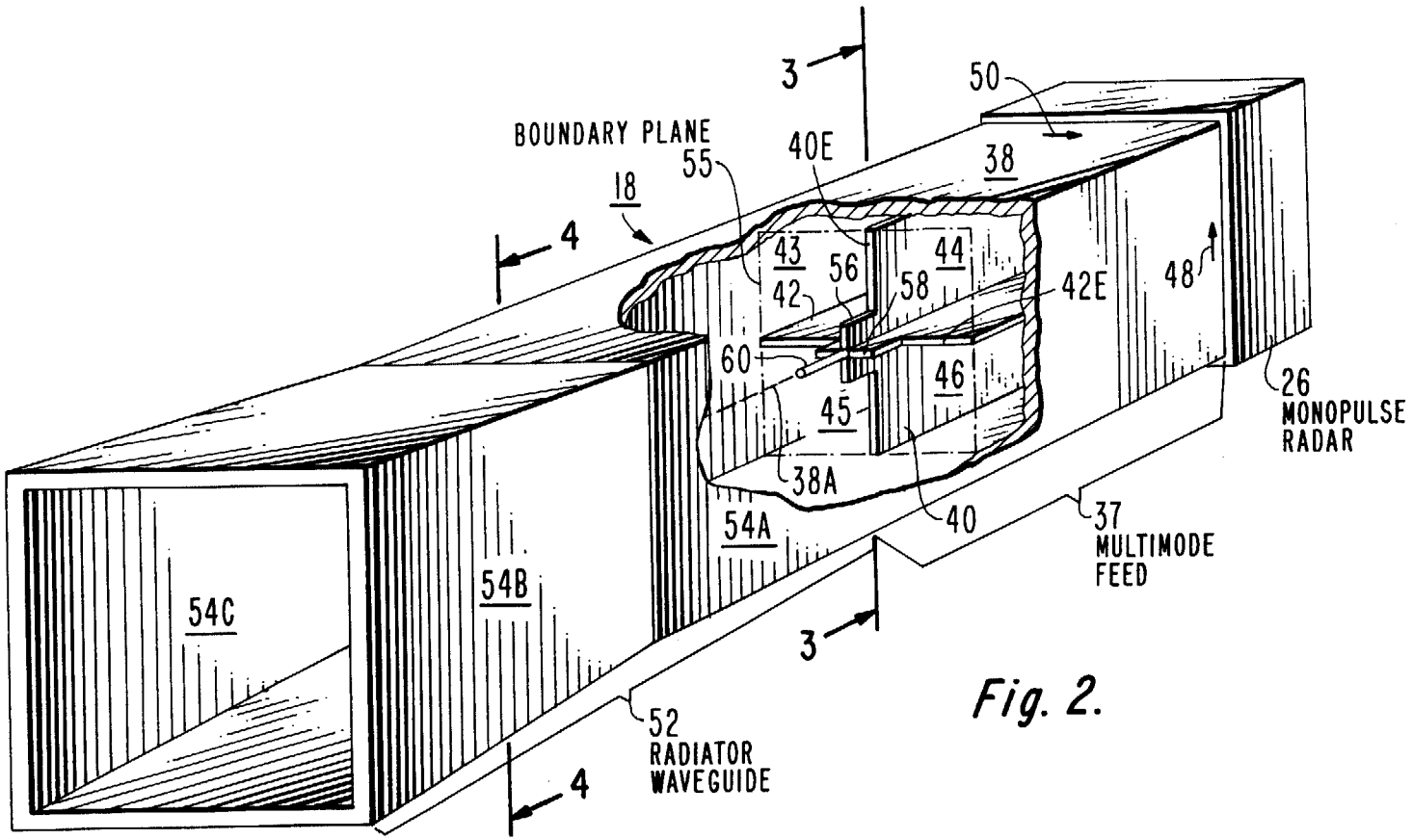
FIG. 2 is a perspective view of a radiator and a multimode feed in the antenna of FIG. 1.

As shown in FIG. 2, radiation element 18 includes a multimode feed 37 comprised of a rectangular housing waveguide 38 with a cavity wherein an electrically conductive wall 40 perpendicularly intersects an electrically conductive wall 42 along the axis 38A of housing 38. Walls 40 and 42 divide the cavity of housing 38 into subwaveguide cavities 43–46 that are all of substantially the same size. That is the walls 40 and 42 bisect each other at the axis 38A of housing 38.

The size of cavities 43–46 is chosen to support a $TE_{10}$ mode of propagation of waves of electromagnetic energy; higher order modes of propagation are not supported within cavities 43–46. Additionally, the polarization of the waves in cavities 43–46 is alternatively in a direction parallel to the direction of an arrow 48 or the direction of an arrow 50. The directions of arrows 48 and 50 are parallel to walls 40 and 42, respectively.

Housing 38 is coaxially disposed with respect to a waveguide radiator 52 that has a waveguide section 54A with a cross-section substantially the same as the cross-section of housing 38. Additionally, radiator 52 has a tapered waveguide section 54B connected to section 54A. The taper of section 54B causes radiator 52 to have an aperture 54C of a desired size.

Housing 38 is integrally connected to section 54A, whereby the cavities of housing 38 and section 54A are contiguous. Walls 40 and 42 have boundary edges 40E and 42E, respectively, within a boundary plane 55 between the cavities of waveguide 38 and section 54A, whereby the boundary edges 40E and 42E are a discontinuity.

Boundary edges 40E and 42E are integrally connected to electrically conductive tabs 56 and 58, respectively, that perpendicularly intersect substantially on axis 38A. Tabs 56 and 58 are parallel to walls 40 and 42, respectively, and extend from boundary 55 into radiator 52. Additionally, the intersection of tabs 56 and 58 is integral with a cylindrical electrically conductive rod 60 disposed within radiator 52 substantially along axis 38A.

As explained hereinafter, tabs 56 and 58 cause radiator 52 to be excited in an $LSE_{12}$ mode when electromagnetic waves of a selected polarization propagate in the $TE_{10}$ mode through cavities 43–46. Protrusion 60, preferably a cylindrical rod, provides a desired polarization of an electromagnetic wave that propagates through radiator 52 in one of two difference modes of radar 26.

The particular dimensions of the tabs 56 and 58 and the protrusion 60, are dependent upon the particular frequency of the propagating electromagnetic energy. For example, at a center frequency of about 35 GHz the tabs 56 and 58 should be about 0.76 centimeters long, 0.04 centimeters thick and extend away from the boundary edges 40E and 42E respectively, about 0.13 centimeters. The protrusion 60 extending beyond the tabs 56 and 58 into the radiator 52 is preferably about 0.25 centimeters long and about 0.08 centimeters in diameter. To use the feed at other frequencies the above dimension can be scaled to accomodate that frequency by multiplying each dimension by a scaling factor k where $k=35/f$(in GHz) and $f$ is the other frequency of operation.

As shown in FIGS. 3*a*, 4*a* and 4*b*, in response to a first type of excitation of cavities 43–46, waves of electromagnetic energy propagate therethrough with a first polarizationn which is in the direction of arrow 48 (FIG. 3*a*). Because of being in the direction of arrow 48, the first polarization is perpendicular to wall 42 and parallel to tab 56.

When the waves of FIG. 3*a* propagate through cavities 43–46, an electromagnetic wave with the first polarization propagates through radiator 52 in the $TE_{10}$ mode (FIG. 4*a*). Additionally, as shown in FIG. 4*b*, an electromagnetic wave propagates through radiator 52 in the $LSE_{12}$ mode (referred to as the $LSE_{12}$ wave hereinafter) because tab 56 extends into radiator 52. The $LSE_{12}$ wave is polarized parallel to the direction of arrow 48.

As shown in a waveform 62 of FIG. 4*b*, the $LSE_{12}$ wave has, for example, maximum field strengths of one polarity within a first plane, perpendicular to the direction of arrow 48, that passes through a point 64. Correspondingly, the $LSE_{12}$ wave has maximum field strengths of an opposite polarity within second and third planes, parallel to the first plane, that pass through points 66 and 68, respectively. Moreover, the $LSE_{12}$ wave has a field strength null within fourth and fifth planes, parallel to the first plane, that pass through points 70 and 72, respectively. At a given location within the first, second or third planes, for example, the field strength is a maximum relative to field strengths along a line perpendicular to the three planes that passes through the given location.

The wave that propagates through radiator 52 in the $TE_{10}$ mode and the $LSE_{12}$ wave combine to comprise a wave that propagates in the sum mode of radar 26. Because the sum mode wave is comprised of the wave that propagates in the $TE_{10}$ mode and the $LSE_{12}$ wave, radiation element 18 causes a desired shaping of a beam than radiates from aperture 54C.

According to the present invention, when the first type of excitation is at a center frequency, there is a relative phase change of 180 degrees between the sum mode waves that propagate from boundary 55 to aperture 54C. Moreover, the 180 degree phase change causes a desired phase relationship between the sum mode waves at aperture 54C. Therefore the phase change in radiation element 18 is 180° less than the phase change in monopulse radiation elements of the prior art. Since a deviation of the frequency of excitation from the center frequency is directly related to a deviation of phase change, radiation element 18 has a greater bandwidth than the radiation elements of the prior art.

Figure 3B:
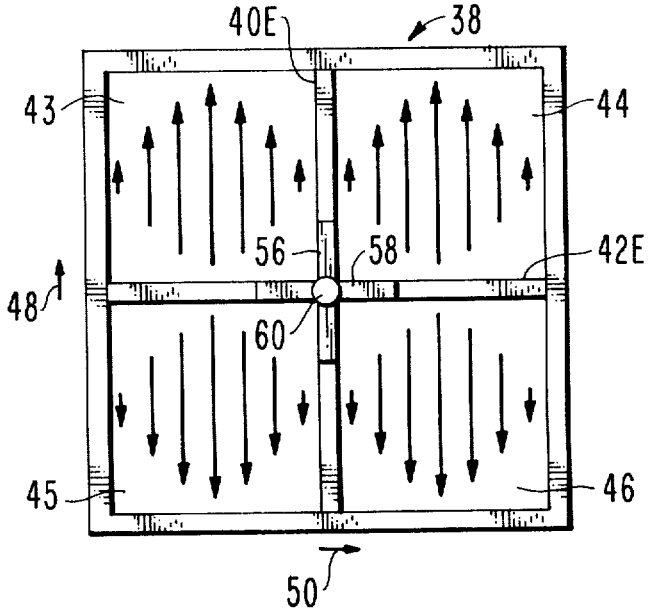
Figure 4C:
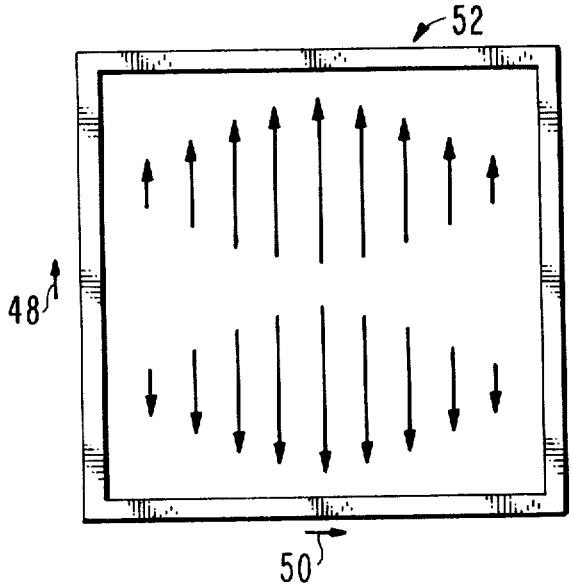

As shown in FIGS. 3*b* and 4*c*, in response to a second type of excitation of cavities 43–46, waves of electromagnetic energy propagate through cavities 43 and 44 with the first polarization (in the direction of arrow 48). Additionally, waves of electromagnetic energy propagate through cavities 45 and 46 with a second polarization which has a direction opposite from the direction of arrow 48.

As shown in FIG. 4*c*, when the waves of FIG. 3*b* propagate through cavities 43–46, a wave of electromagnetic energy propagates through radiator 52 in the $LSE_{11}$ mode (referred to as an $LSE_{11}$ wave hereinafter) polarized parallel to the direction of arrow 48. As known to those skilled in the art, the $LSE_{11}$ wave may be resolved into one component that propagates in the $TM_{11}$ mode and another component that propagates in the $TE_{11}$ mode. Moreover, when the components do not have desired relative amplitudes and phases, the $LSE_{11}$ wave is depolarized. According to the present invention, the components have the desired relative amplitudes and phases when rod 60 has a desired length. The $LSE_{11}$ mode is the E plane difference mode of radar 26.

Figure 3C:
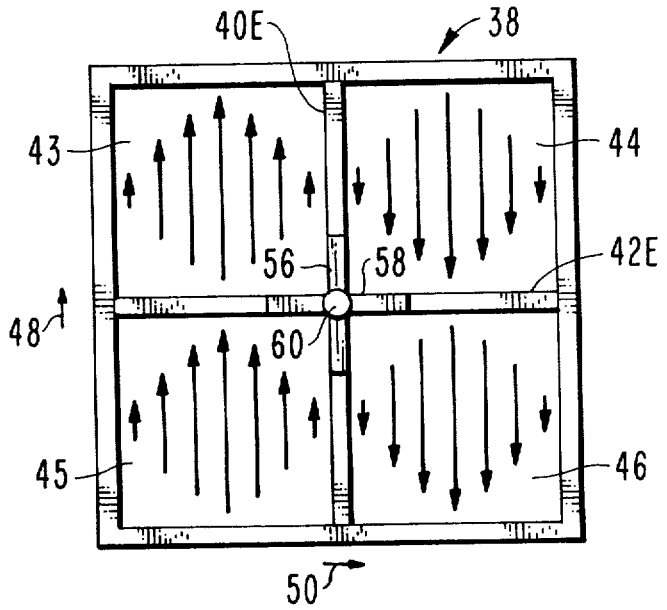
Figure 4D:
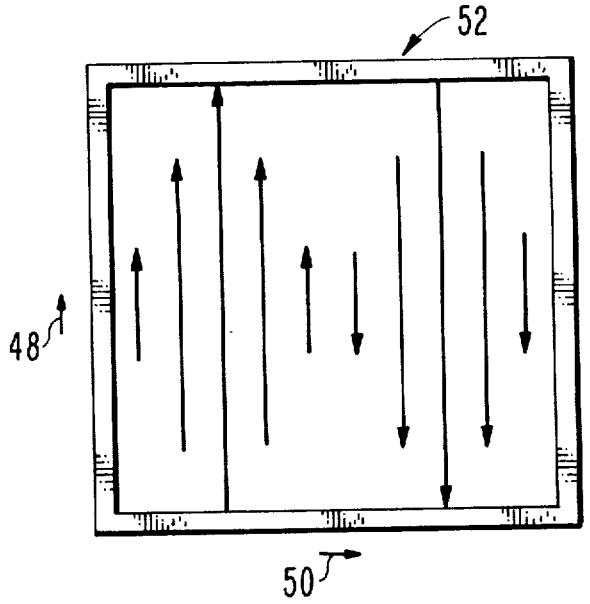

As shown in FIGS. 3*c* and 4*d*, in response to a third type of excitation of cavities 43–46, waves of electromagnetic energy propagate through cavities 43 and 45 with the first polarization (in the direction of arrow 48). Additionally, waves of electromagnetic energy propagate through cavities 44 and 46 with the second polarization (in the direction opposite that of arrow 48) whereby waves of opposite polarity propagate through housing 38 on opposite sides of wall 40.

Since the waves of FIG. 3*c* propagate in the $TE_{10}$ mode, they are associated with a field strength that is null in the plane of wall 40. As known to those skilled in the art, because of the opposite polarities on opposite sides of wall 40 and the null in the plane of wall 40, the waves of FIG. 3*c* comprise components of a wave that propagates through housing 38 in a $TE_{20}$ mode.

From the description given hereinbefore, edge 40E and tab 56 are disposed in a plane where there is a null in the field strength associated with the wave that propagates in the $TE_{20}$ mode. Moreover, edge 42E and tab 58 are disposed in a plane perpendicular to the direction of the first and second polarizations. Similarly, rod 60 is disposed along axis 38A where the field strength is a null. An electromagnetic wave is not affected by a structure disposed at a null in the field strength associated with the wave. Additionally, an electrically conductive wall does not affect an electromagnetic wave that is polarized perpendicularly to the wall. Therefore, edges 40E and 42E, tabs 56 and 58 and rod 60 have no effect on the wave that propagates in the $TE_{20}$ mode, whereby the wave propagates in the $TE_{20}$ mode through radiator 52 with no depolarization. As known to those skilled in the art, the $TE_{20}$ mode is the H plane difference mode of radar 26. It should be understood that FIGS. 3*c* and 4*d* are equivalent showings of the wave that propagates in the $TE_{20}$ mode.

When electromagnetic waves polarized orthogonal to the directions of the first and second polarization propagate through cavities 43–46 and radiation element 18, tab 58 causes an $LSE_{12}$ mode of propagation of a wave through radiator 52 in a manner similar to the $LSE_{12}$ mode of propagation caused by tab 56 described hereinbefore. Moreover, radiation element 18 and cavities 43–46 are of a symmetrical construction whereby electromagnetic waves may propagate in all modes similar to those described hereinbefore.

What is claimed is:

1. A multimode feed for coupling a wave of electromagnetic energy at a predetermined frequency between a monopulse radar and a waveguide radiator that has a first cavity with a rectangular cross-section at one end and a first center axis, said feed comprising:

a rectangular housing waveguide that has a second cavity with a cross-section substantially the same as said rectangular cross-section of said radiator and, a second center axis, one end of said housing waveguide being axially aligned and connected to said one end of said radiator to cause the first and second cavities of said radiator and said housing waveguide, respectively, to be contiguous;

a pair of perpendicularly intersecting, electrically conductive walls connected within said housing waveguide, said conductive walls bisecting each other at said second center axis of said second cavity to subdivide said second cavity thereof into four equal rectangular subwaveguide cavities that each support a $TE_{10}$ mode of propagation of a first electromagnetic wave at said frequency having a known polarization and a second electromagnetic wave at said frequency having a polarization orthogonal to said known polarization, each of said walls having a boundary edge substantially at the boundary between said first and second contiguous cavities; and means for generating $LSE_{12}$ mode waves at said frequency initially out of phase with said $TE_{10}$ mode wave, said means including a pair of electrically conductive tabs connected to the boundary edges of said walls, said tabs being substantially shorter than said walls and intersecting each other at said first center axis of said first cavity, said tabs extending across said connection between said housing waveguide and said radiator and into said first cavity of said radiator with at least one of said tabs being substantially parallel to the direction of said known polarization and at least one of said tabs being parallel to said polarization of said second electromagnetic wave.

2. The multimode feed of claim 1 additionally comprising an electrically conductive rod, said rod being connected to said axial intersection of said electrically conductive tabs and extending into said first cavity of said radiator along said first center axis thereof.

3. In a Cassagrain antenna of the type including a paraboloid reflector, the improvement comprising:

a waveguide radiator having a first cavity with a rectangular cross-section at one end and a first center axis;

a rectangular housing waveguide having a second cavity with a cross-section substantially the same as said rectangular cross-section of said radiator and having a second center axis, one end of said housing waveguide being axially aligned and connected to said one end of said radiator to cause said first and second cavities of said radiator and said housing waveguide, respectively, to be contiguous, the other end of said radiator being connected to the paraboloid reflector along its axis;

a pair of perpendicularly intersecting, electrically conductive walls connected within said housing waveguide, said conductive walls bisecting each other at said second center axis of said cavity to subdivide said second cavity into four equal rectangular subwaveguide cavities that each support a $TE_{10}$ mode of propagation therethrough of a first electromagnetic wave at a predetermined frequency having a known polarization and a second electromagnetic wave at said frequency having a polarization orthogonal to said known polarization, each of said walls having a boundary edge substantially at the boundary between said first and second contiguous cavities; and means for generating $LSE_{12}$ mode waves at said frequency initially 180° out of phase with said $TE_{10}$ mode wave, said means including a pair of electrically conductive tabs connected to the boundary edges of said walls, said tabs being substantially shorter than said walls and intersecting each other at said first center axis of said first cavity, said tabs extending across said connection between said housing waveguide and said radiator and into said first cavity of said radiator with at least one of said tabs being substantially parallel to the direction of said known polarization and at least one of said tabs being parallel to said polarization of said second electromagnetic wave.

4. The Cassagrain antenna as claimed in claim 3 additionally comprising an electrically conductive rod, said rod being connected at said axial intersection of said electrically conductive tabs and extending into said first cavity of said radiator along said first center axis thereof.

* * * * *